US006869553B1

(12) United States Patent
Gentile

(10) Patent No.: US 6,869,553 B1
(45) Date of Patent: Mar. 22, 2005

(54) METHOD FOR FORMING A PRECAST BRICK RISER

(76) Inventor: John D. Gentile, 3983 Dover Center Rd., North Olmsted, OH (US) 44070

( * ) Notice: Subject to any disclaimer, the term of this patent is extended or adjusted under 35 U.S.C. 154(b) by 17 days.

(21) Appl. No.: 10/193,039

(22) Filed: Jul. 12, 2002

(51) Int. Cl.[7] ..... E04G 23/02; E04G 13/06; E04F 11/116; E04F 21/26

(52) U.S. Cl. ..... 264/31; 264/36.18; 264/36.2; 264/245; 264/246; 264/256; 264/271.1; 264/275; 264/277; 264/279; 264/333; 249/14; 249/15; 52/189; 52/314; 52/741.2; 52/745.1

(58) Field of Search ..... 264/31, 36.2, 36.18, 264/245, 246, 256, 271.1, 275, 277, 279, 333; 249/14, 15; 52/189, 314, 741.2, 745.1

(56) References Cited

U.S. PATENT DOCUMENTS

| | | | | | |
|---|---|---|---|---|---|
| 1,932,274 | A | | 10/1933 | Kublanow | 52/385 |
| 1,933,237 | A | * | 10/1933 | Aberson | 52/385 |
| 1,984,087 | A | | 12/1934 | Scheel | 249/14 |
| 1,985,143 | A | | 12/1934 | Buffaloe | 52/189 |
| 2,122,696 | A | * | 7/1938 | Poston | 52/389 |
| 2,155,908 | A | | 4/1939 | Samonds | 249/14 |
| 2,558,615 | A | | 6/1951 | Johnson | 249/14 |
| 2,577,864 | A | * | 12/1951 | Thorton et al. | 52/190 |
| 2,815,657 | A | * | 12/1957 | Price | 52/189 |
| 2,971,238 | A | * | 2/1961 | Forssell | 264/162 |
| 3,025,772 | A | | 3/1962 | Palatini | 404/18 |
| 3,466,820 | A | | 9/1969 | Sender | 52/188 |
| 3,521,418 | A | | 7/1970 | Bartoloni | 52/318 |
| 3,706,170 | A | * | 12/1972 | Argraves et al. | 52/189 |
| 3,755,521 | A | * | 8/1973 | Young et al. | 264/69 |
| 3,775,916 | A | * | 12/1973 | Bair | 52/125.4 |
| 3,789,102 | A | * | 1/1974 | Hazelett, Jr. | 264/295 |
| 3,875,708 | A | | 4/1975 | Thorsnes | 52/189 |
| 4,005,972 | A | * | 2/1977 | Sommers | 425/439 |
| 4,026,083 | A | | 5/1977 | Hoyt | 52/387 |
| 4,183,188 | A | * | 1/1980 | Goldsby | 52/596 |
| 4,765,115 | A | | 8/1988 | Pollina | 52/712 |
| 4,915,888 | A | * | 4/1990 | Sato | 264/71 |
| 4,957,685 | A | | 9/1990 | Boot | 264/261 |
| 4,995,205 | A | * | 2/1991 | Bennett | 52/189 |
| 5,770,244 | A | | 6/1998 | Braungardt et al. | 425/443 |
| 6,070,380 | A | | 6/2000 | Meilleur | 52/309.7 |

FOREIGN PATENT DOCUMENTS

| | | | | |
|---|---|---|---|---|
| EP | 984118 | A2 * | 3/2000 | E04H/17/16 |

* cited by examiner

*Primary Examiner*—Michael P. Colaianni
*Assistant Examiner*—Michael I. Poe
(74) *Attorney, Agent, or Firm*—Joseph H. Taddeo

(57) ABSTRACT

A method of manufacturing a prefabricated precast riser module, where the required forms that are used in casting the modules are reusable and need not to be transported to the construction site. Each precast riser assembly is finished having brick facings. Brick facings are applied to the vertical surfaces of the precast riser. They are: the commonly used stretcher course and row lock course. A Rebar reinforcing rod is imbedded in the concrete mixture, which will strengthen the assembly to prevent damage when being transported on site. This added strengthening would also allow for minor misalignments during the assembly phase. These novel concrete brick faced modules can be assembled by inexperienced craftsmen, and when completed, will give the appearance of a handcrafted riser that was constructed by professional masonry craftsmen using brick and sandstone.

6 Claims, 10 Drawing Sheets

METHOD FOR FORMING A PRECAST BRICK RISER

FIELD OF INVENTION

The present invention relates primarily to improved artificial stone steps and, more particularly, to the manufacture and forming of precast modular concrete and brick slab faced risers that are factory assembled modularly and installed on site to create the finished product thereof.

BACKGROUND OF THE INVENTION

Stone steps over the years have been replaced in use by artificially constructed concrete steps. These concrete stairs are typically formed and erected on site by using temporary molds constructed using forms made of lumber. As such, these molds are set up and assembled for each job, requiring considerable labor and skill because each job differs from another, such that each job requires the construction of new forms.

The following prior art discloses the various aspects in the design and use of forms used in the construction of casts concrete steps.

U.S. Pat. No. 1,985,143, granted Dec. 18, 1934, to B. E. Buffaloe, teaches of precast steps for outdoor use, having two precast concrete jacks, comprising a base portion, a vertical portion and an inclined portion. The inclined jack portion is provided with a plurality of tread receiving surfaces and risers. L-shaped anchors are embedded, centrally positioned on each tread surface, of one rod per tread surface, where assembly, a hole in the tread is positioned over the rod anchor. Once the tread is placed in the desired position, the tapered hole in the tread is filled with cement, embedding the anchor rod, thereby securing the tread to the carriage.

U.S. Pat. No. 2,155,908, granted Apr. 25, 1939, to L. Sumonds, discloses a concrete step mold comprised of two major parts, a wooden part and a formed metal part. The wooden part includes two L-shaped end walls, a larger longitudinal sidewall and a smaller longitudinal sidewall. The form is so arranged that concrete is poured into the opening, thus forming an L-shaped, integrally formed, concrete step and riser, where the step and riser are prefabricated for refacing old and worn concrete steps.

U.S. Pat. No. 2,558,615, granted Jun. 26, 1951, to E. J. Johnson, discloses a mold or form for molding conventional tread and riser step units, and suitable stepped side wall members, having a series of tongues and grooves being provided in the end walls, and tread and riser units, adapted for interlocking engagement.

Presently, the above prior art teaches of molds, for use in the construction of concrete, out-of-doors steps. None of the above referenced prior art teaches of a modularized, prefabricated and pre-finished block of concrete, having a unitized riser, that can be transported in an assembled condition for insertion under a tread on site to create an artificial brick and stone stoop that simulates one that was handcrafted.

What is needed is a modularized approach in the creation of a riser that supports a tread in a prefabricated subassembly that when inserted in a stoop on site by inexperienced craftsmen, will give the appearance of a professionally handcrafted stoop, which may be used at the entrance of a dwelling. In this regard, the present invention fulfills this need.

It is therefore an object of the present invention to provide for a method for forming a modular precast brick-face, concrete riser to support a tread, and the resulting product thereby created.

It is another object of the present invention to provide for the forming of a modular precast brick-faced, concrete riser, that upon assembly will simulate a concrete cast and brick riser having the appearance of a hand crafted stretcher course.

It is still another object of the present invention to provide for the forming of a modular precast brick-faced, concrete riser, that upon assembly will simulate a handcrafted riser having the appearance of a row lock course.

It is a final object of the present invention to provide for the forming of a modular precast brick-faced, concrete riser to support a tread, that upon assembly will simulate a riser having the appearance of a handcrafted brick riser in a stone stoop, that is less costly and that can be assembled by inexperienced craftsmen.

These as well as other objects and advantages of the present invention will be better understood and appreciated upon reading the following detailed description of the preferred embodiment when taken in conjunction with the accompanying drawings.

SUMMARY OF THE INVENTION

The present invention relates to a method of manufacturing a prefabricated precast riser module. The required forms that are used in casting the modules are reusable and need not to be transported to the construction site.

Each precast riser assembly is finished having brick facings that are bonded to the concrete casting by using a thin set mortar.

Two types of brick facings or courses can be applied in the vertical surfaces of the precast riser for supporting a tread. They are: the commonly used stretcher course and the row lock course.

All of the precast subassemblies can be manufactured at a remote manufacturing facility, and subsequently transported to a storage and distribution center, where they would become available at a retail home improvement center.

These concrete brick faced modules can be assembled by inexperienced craftsmen, and when completed, will give the appearance of a handcrafted stoop that was constructed by professional masonry craftsmen.

A Rebar reinforcing rod is imbedded in the concrete mixture, which will strengthen the assembly to prevent damage when being transported on site. This added strengthening would also allow for minor misalignments during the assembly phase. As such, the succeeding disclosure fulfills that objects of the invention by providing:

A prefabricated riser comprising a cement substructure formed with a Rebar reinforcing rod imbedded near the substructure center for added strength of the riser and a brick superstructure including a plurality of brick slabs. Each brick slab is a cut portion of a standard brick with an irregular underside and a smooth outer surface. The brick slabs are imbedded in the cement in a linear alignment of the adjacent slabs, whereby the outer smooth brick surface of the co-planar slabs provide a smooth brick-faced panel comprising a brick veneer on the surface or a side of the rectangular substructure. Each brick slab is stabilized by cement tooled in the spaces between each of the slabs and the brick veneer projects beyond each end of the cement substructure. The prefabricated riser is a modular unit that is transportable from a manufacturing location to a stoop under repair as an integral piece for placement under, and permanent support of, a stone tread on several leveling shims in place of an old brick course, whereupon all open joints are pointed with mortar that is trimmed flush with the brick veneer. Each sidewall of the stoop is completed using matching conventional bricks to fill in each sidewall. The brick slabs may be imbedded in the cement in a stretcher course pattern or a row lock course pattern.

BRIEF DESCRIPTION OF THE DRAWINGS

The present invention is pictorially illustrated in the accompanying drawings that are provided herein.

DETAILED DESCRIPTION OF THE INVENTION

Figure 1:
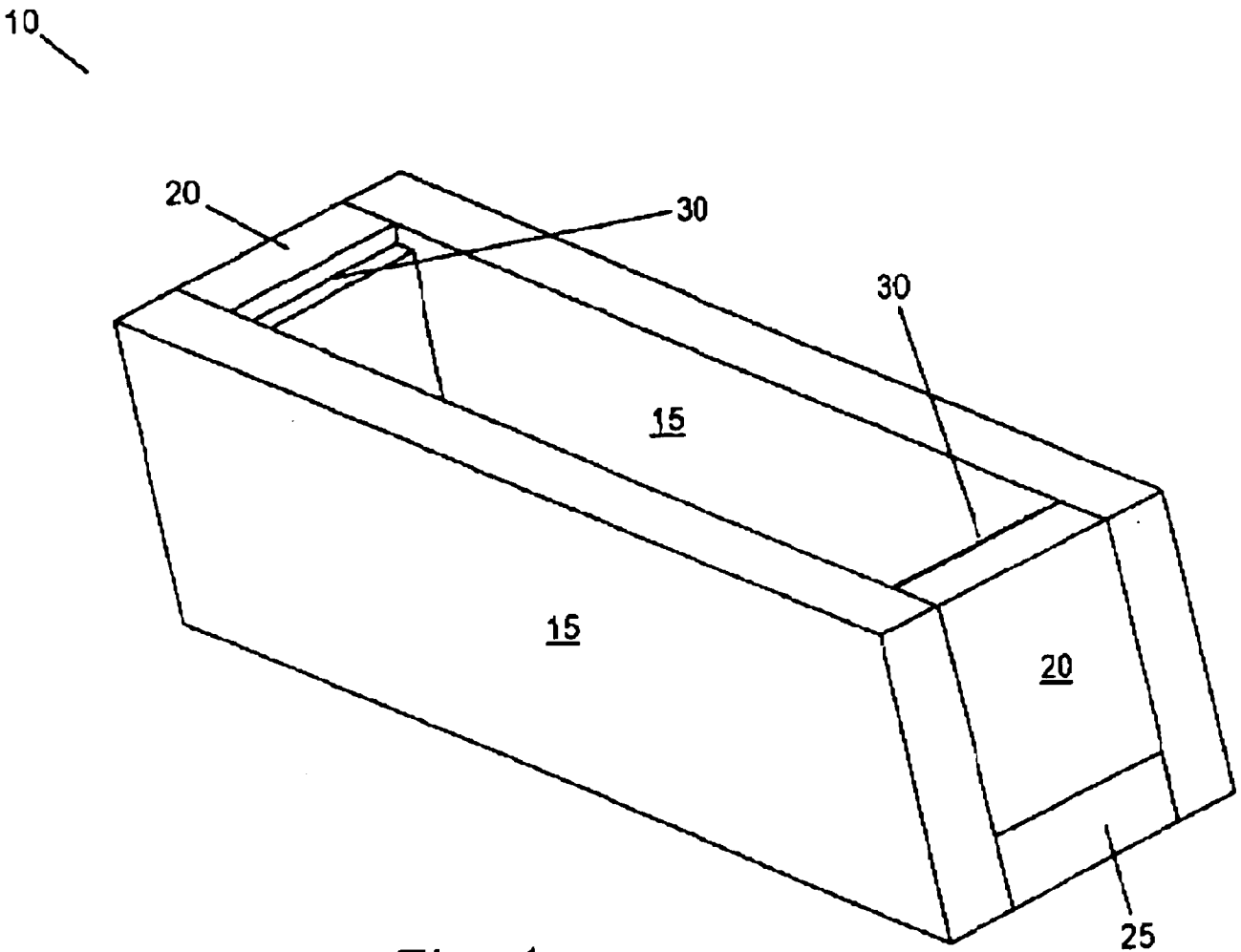
FIG. 1 is a perspective view of the form used in manufacturing the brick and concrete stretcher course type riser.

The novel concrete form 10, for use in manufacturing the precast riser having a stretcher course arrangement for the brick slab facings, is shown in FIG. 1. Two sidewalls 15, running lengthwise, two end walls 20, and a bottom portion 25, comprise the form. The form 10 is preferably made of wooden construction, although it may be constructed from any other suitable material.

There is a grooved notch 30 extending across the top inner side of each end wall 20 that will accommodate the brick slab facings in the completed precast riser. The width and height of the notch is sized to be the approximate thickness of the brick slabs.

Figure 3:
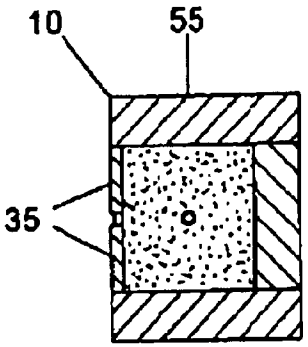
FIG. 3 is a side sectional view of the form that is used in manufacturing the brick and concrete stretcher course type riser, taken along the line 3—3 of FIG. 2, along with the partially completed riser and its centered Rebar reinforcement remaining in the cavity of the form.
Figure 2:
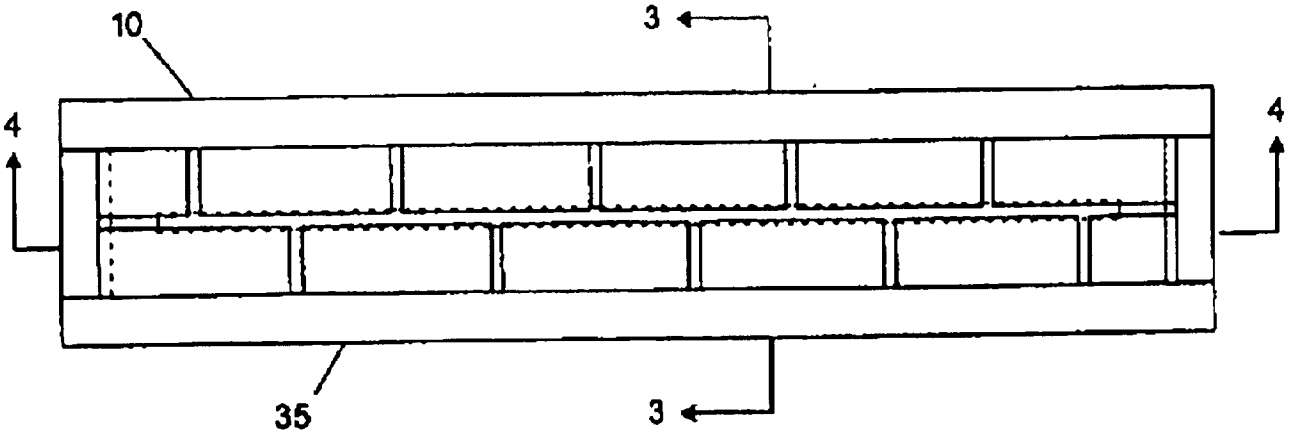
FIG. 2 is a top view of the form using in manufacturing the brick and concrete stretcher course type riser, along with the partially completed riser remaining in the cavity of the form.

In FIGS. 2 and 3, the form is shown to be sized in a multiple of multiplies of the length and width of the brick slabs 35, and for allowing approximately one-half inch for the inter-brick-slab spacing.

Figure 4:
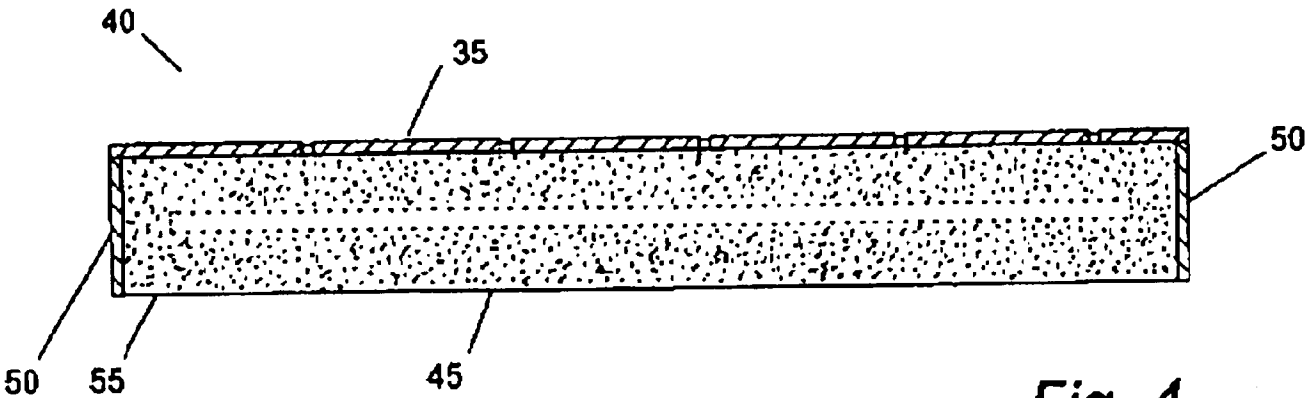
FIG. 4 is an orthogonal sectional view of the finished product, having the brick slabs imbedded into the top shown surface and brick slabs cemented to the sidewalls of the precast riser of the preferred embodiment, taken along the line 4—4 of FIG. 2.

FIG. 4 shows the side elevation of the finished precast, stretcher-source type product 40, where the end-brick slabs 50 are added after the precast concrete element 45 is removed from the form.

Figure 5:
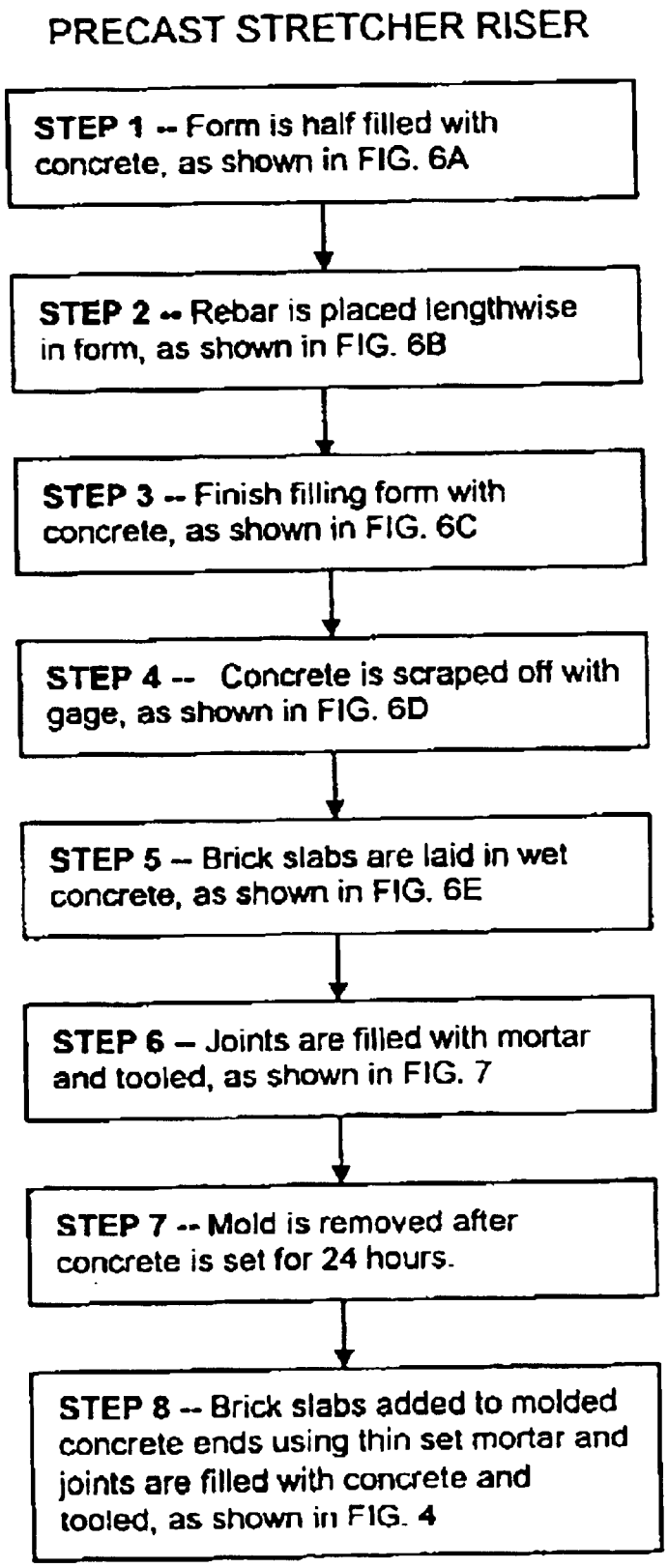
FIG. 5 is a flowchart depicting the manufacturing procedure in making the stretcher course type riser.
Figure 6A:
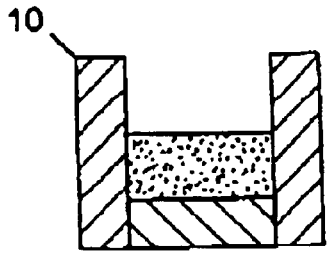
FIG. 6A is a side sectional view of the form, taken along the line 3—3 of FIG. 2, showing the cavity of the form half filled with concrete.

The method of manufacturing the precast stretcher type riser is briefly described in flowchart FIG. 5 and illustrated in FIGS. 6A, 6B, 6C, 6D, 6E, 7 and 8. Each brick slab 35 for the stretcher course is a slice of a standard brick. Such a brick slab or sliced brick for a stretcher course is first formed by cutting a standard rectangular brick with a cut parallel and proximate to a lengthwise side of the brick to provide an irregular underside and a smooth outer surface for each brick slab. The detailed method for manufacturing a precast riser for a stretcher course follows:

STEP 1.—As shown in FIG. 6A, the form is filled with the concrete mixture to its midpoint so that the Rebar, reinforcing rod, could be added to give the finished product added strength.

Figure 6B:
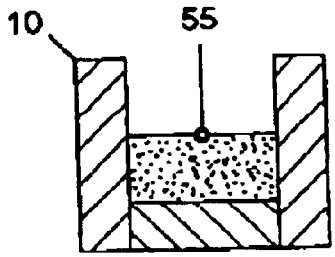
FIG. 6B is a side sectional view of the form, taken along the line 3—3 of FIG. 2, showing the reinforcing rod placed centrally on the surface of the concrete mixture.
Figure 6C:
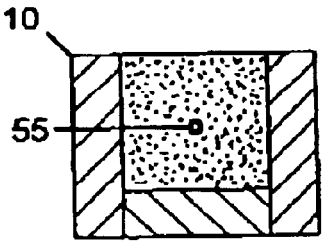
FIG. 6C is a side sectional view of the form, taken along the line 3—3 of FIG. 2, showing the cavity of the form completely filled with the concrete mixture.

STEP 2.—FIG. 6B shows the Rebar, reinforcing rod, 55, laid lengthwise in the form to give the finished product added strength. The Rebar is cut about 4 inches shorter the inside dimension of the form, which will allow 2 inches of clearance at each end.

STEP 3.—Next, the remainder of the form 10 is filled with the concrete mixture to the height of the form. This step is pictorially illustrated in FIG. 6C.

Figure 6D:
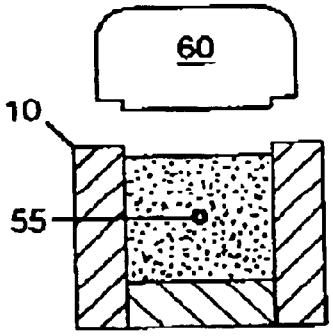
FIG. 6D is a side sectional view of the form, taken along the line 3—3 of FIG. 2, showing the cavity of the form completely filled with the concrete mixture, then lowered in level to accommodate the brick slabs.

STEP 4.—The scraper 60 is used to remove the excess concrete from the top surface of the concrete. The scraper gages and controls the amount of concrete removed from the surface of the concrete so that it will accommodate the thickness of the brick slabs and maintain them flush with the height of the form. The scraper 60 and the newly controlled height of concrete are shown in FIG. 6D.

Figure 6E:
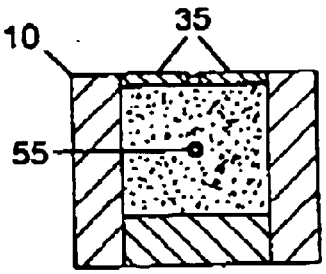
FIG. 6E is a side sectional view of the form, taken along the line 3—3 of FIG. 2, showing the brick slabs laid into the wet concrete.
Figure 7:
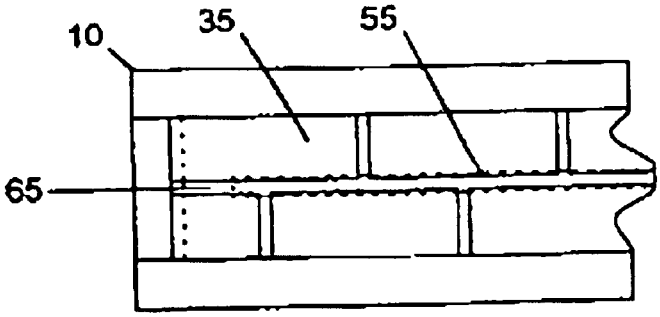
FIG. 7 is a partial top view of the form, showing the brick slabs laid into the web concrete and having the joints filled with mortar and subsequently tooled.

STEP 5.—The brick slabs or cut bricks 35 are then positioned on the scraped surface, and arranged in the stretcher course pattern, as shown in FIGS. 2, 6E and 7. They are first positioned properly, then pressed into the web concrete mixture to imbed them permanently in place.

STEP 6.—The joints between the brick slabs are then filled with mortar and tooled, as shown in FIG. 7.

STEP 7.—After the concrete has set up and cured for at least 24 hours, the riser element 45 is removed from the form.

STEP 8.—The brick end slabs are added to the molded concrete ends, using a thin set mortar, the joints filled and then tooled, giving a finished product as shown in FIG. 4.

Figure 9:
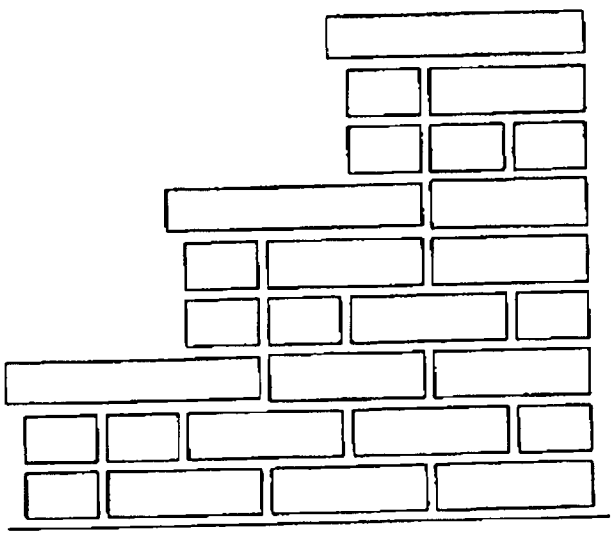
FIG. 9 is a side elevational view of a completed 3-stage stoop having been made with three stretcher course risers.
Figure 8:
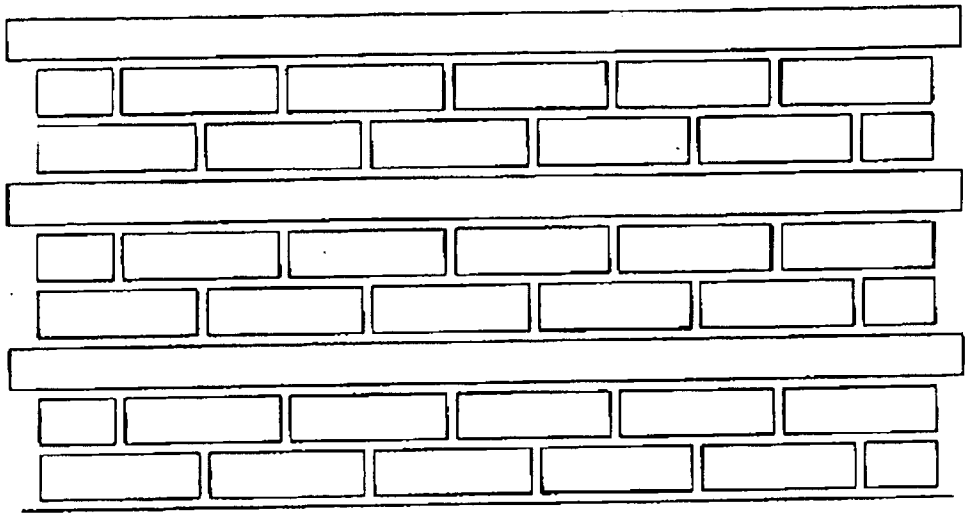
FIG. 8 is a front elevational view of a completed 3-stage stoop having been made with three stretcher course risers.

There is shown in FIGS. 8 and 9, a typical application of the use of the finished novel stretcher-course type precast riser. Illustrated is a 3-step stoop using three of the novel prefabricated concrete risers. Completing the stoop are the stone treads and the side walls using matching conventional bricks to fill in the sidewall.

Figure 10:
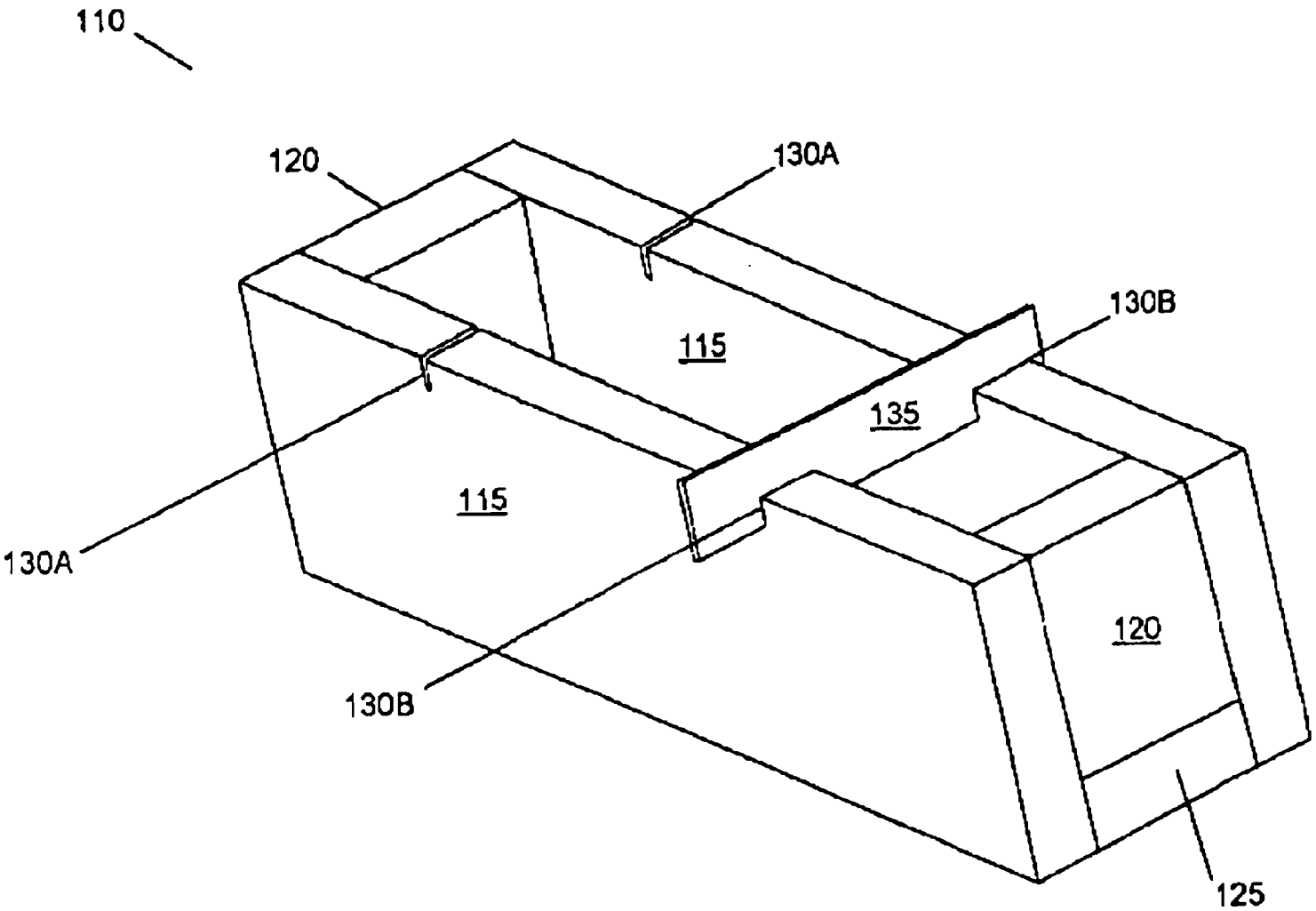
FIG. 10 is a perspective view of the form used in manufacturing the brick and concrete row lock course type riser.

In another embodiment of the present invention, the manufacturing process of a row lock course of brickwork follows:

Turning now, to FIG. 10, there is shown the form used in manufacturing the novel precast concrete riser using a row lock course of brickwork. Two sidewalls 115, running lengthwise, two end walls 120, and a bottom portion 125, comprise the form. The form 110 is preferably made of wood, similar to that used in the previously described form, although it may be constructed from any other suitable material.

There are four slots 130 in the sidewalls 115, designed to receive end-cap gages 135, where in the resulting finished product, the end-caps are designed to simulate sandstone blocks.

Figure 12:
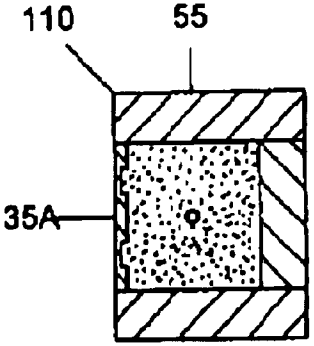
FIG. 12 is an orthogonal sectional view of the finished product, having the brick slabs imbedded into the top shown surface of the precast riser of the preferred embodiment, taken along the line 12—12 of FIG. 11.
Figure 11:
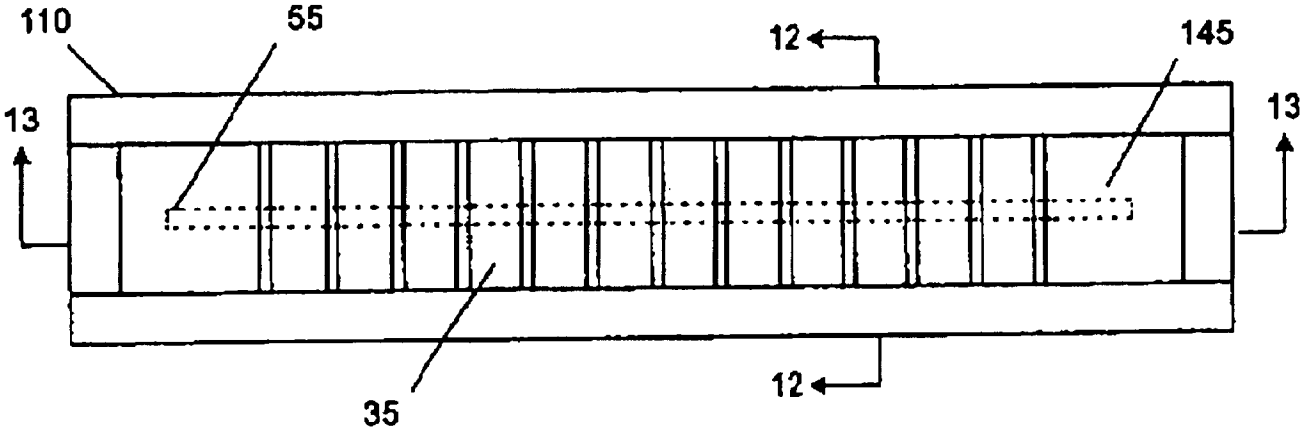
FIG. 11 is a top view of the form that is used in manufacturing the brick and concrete row lock course type riser, along with the partially completed riser remaining in the cavity of the form.

As shown in FIGS. 11 and 12, this form is shown sized in multiples of the length and width of the brick slabs, and for allowing approximately one-half inch for the inter-brick slab spacing.

Figure 13:
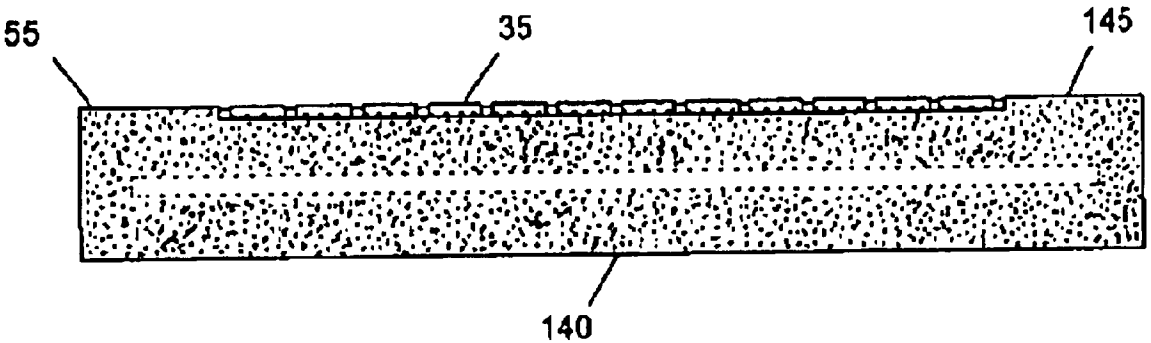
FIG. 13 is a side section view of the riser form, taken along line 13—13 of FIG. 11, for use in manufacturing the brick and concrete row lock course type riser.

FIG. 13 shows the side elevation of the finished precast, row lock course type product 140, where the finished concrete ends 145 simulate by their appearance end caps made of sandstone.

Figure 14:
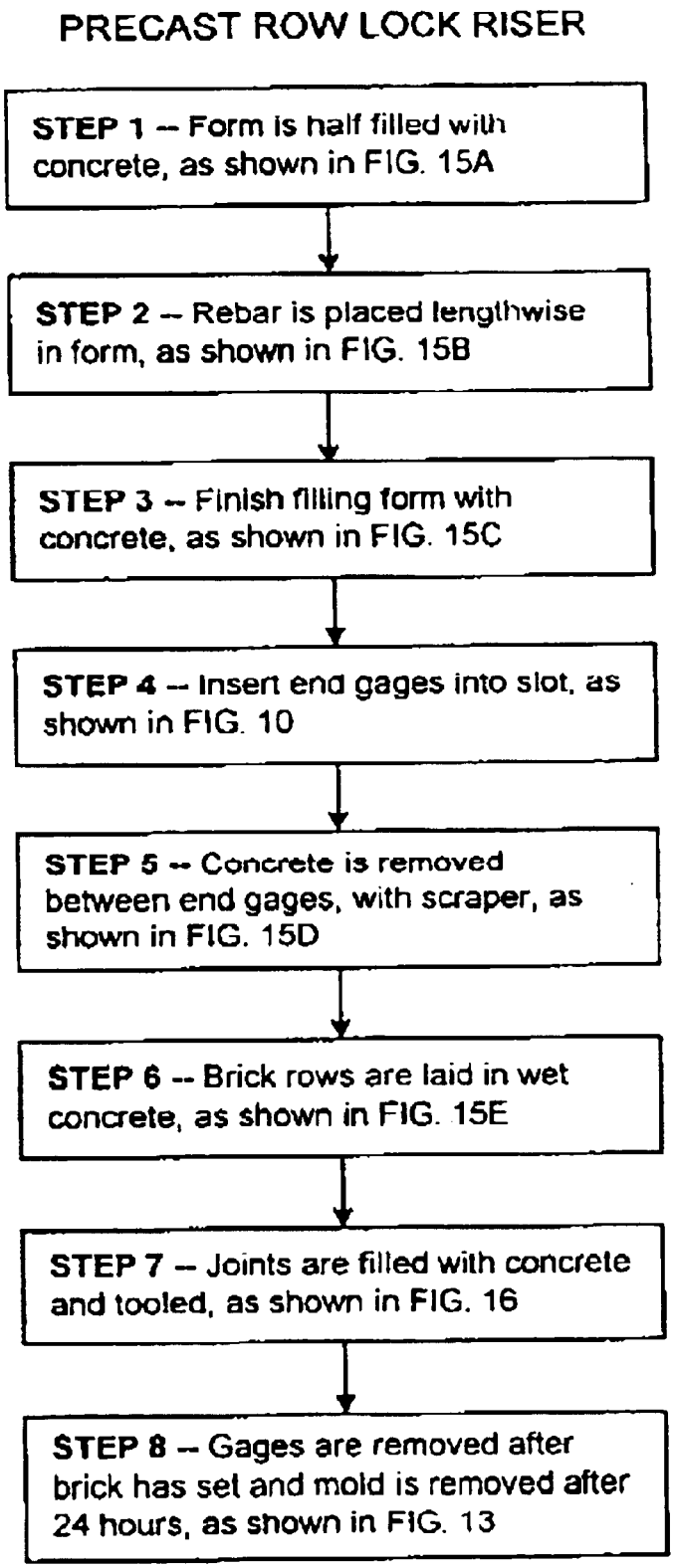
FIG. 14 is a flowchart depicting the manufacturing procedure in making the row lock course type riser.
Figure 15A:
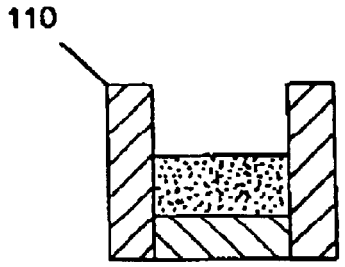
FIG. 15A is a side sectional view of the form, taken along the line 12—12 of FIG. 11, showing the cavity of the form half filled with concrete.

The method of manufacturing the precast row lock type riser is briefly described in flowchart FIG. 14 and illustrated in FIGS. 15A, 15B, 15C, 15D, 15E, and 16. Each brick slab 35A for the row lock course is a slice of a standard brick. Such a brick slab or sliced brick 35A for a row lock type riser is first formed by cutting the ends from a standard rectangular brick. Such end cut is made parallel and proximate each end of the brick to provide an irregular underside and a smooth outer surface. The detailed method of manufacturing this row lock type riser follows:

STEP 1.—As shown in FIG. 15A, the form is filled with the concrete mixture to its midpoint so that the Rebar, reinforcing rod, could be added to give the finished product added strength.

Figure 15B:
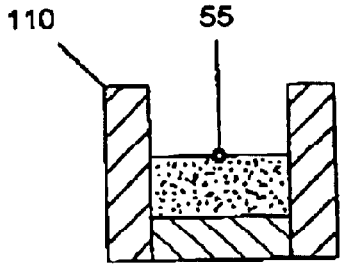
FIG. 15B is a side sectional view of the form, taken along the line 13—13 of FIG. 11, showing the reinforcing rod placed centrally on the surface of the concrete mixture.
Figure 15C:
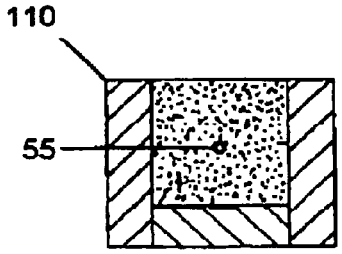
FIG. 15C is a side sectional view of the form, taken along the line 13—13 of FIG. 11, showing the cavity of the form completely filled with the concrete mixture.

STEP 2.—FIG. 15B shows the Rebar, reinforcing rod, 55, laid lengthwise in the form to give the finished product added strength. The Rebar is cut about 4 inches shorter the inside dimension of the form, which will allow 2 inches of clearance at each end.

STEP 3.—Next, the remainder of the form 110 is filled with the concrete mixture to the height of the form. This step is pictorially illustrated in FIG. 15C.

STEP 4.—The end gages 125 are inserted into slots 130A and 130B, as shown in FIG. 10.

Figure 15D:
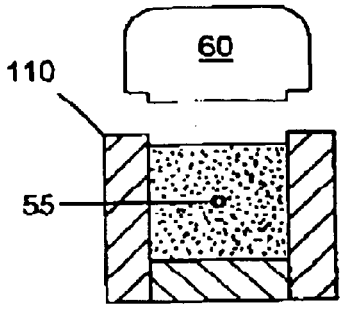
FIG. 15D is a side sectional view of the form, taken along the line 13—13 of FIG. 11, showing the cavity of the form completely filled with the concrete mixture, then lowered in level to accommodate the brick slabs.

STEP 5.—The scraper 60 is used to remove the excess concrete from the top surface of the concrete that lies between slots 130A and slots 130B. The scraper gages and controls the amount of concrete removed from the surface of the concrete so that it will accommodate the thickness of the brick slabs and maintain them flush with the height of the form. The scraper 60 and the newly controlled height of concrete are shown in FIG. 15D.

Figure 15E:
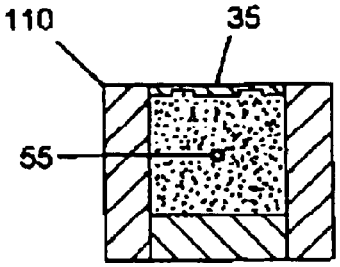
FIG. 15E is a side sectional view of the form, taken along the line 13—13 of FIG. 11, showing the brick slabs laid into the web concrete.
Figure 16:
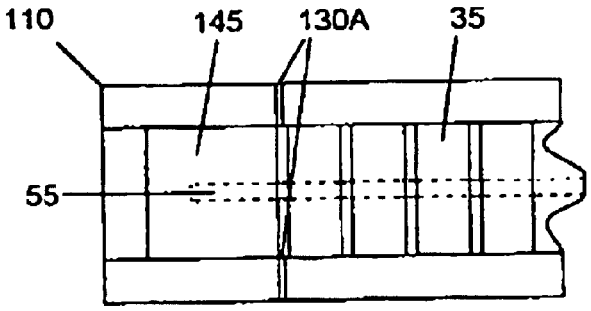
FIG. 16 is a partial top view of the form, showing the brick slabs laid into the wet concrete and having the joints filled with mortar and subsequently tooled with concrete ends finished to simulate sandstone blocks.

STEP 6.—The brick slabs 35A are then positioned on the scraped surface, and arranged in the row lock course pattern, as shown in FIGS. 11, 15E, and 16. They are first positioned properly, then pressed into the wet concrete mixture to imbed them permanently in place.

STEP 7.—The joints between the brick slabs are then filled with mortar and tooled, as shown in FIG. 16.

STEP 8.—After the concrete has set up and cured for at least 24 hours, the riser element 140 is removed from the form.

Figure 18:
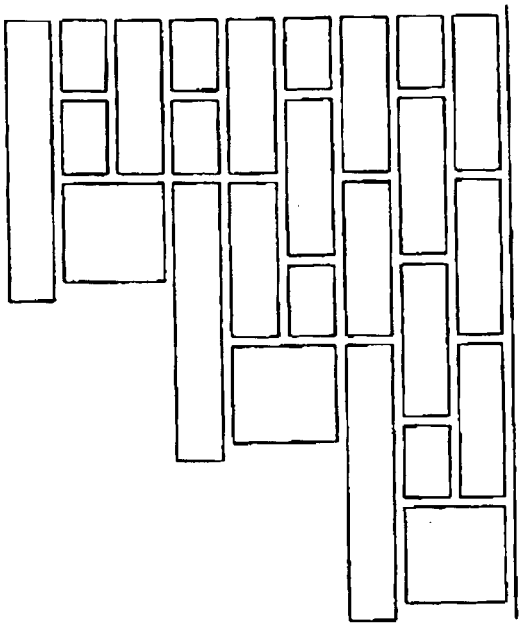
FIG. 18 is a side elevational view of a completed 3-step stoop having been made with three row lock course risers.
Figure 17:
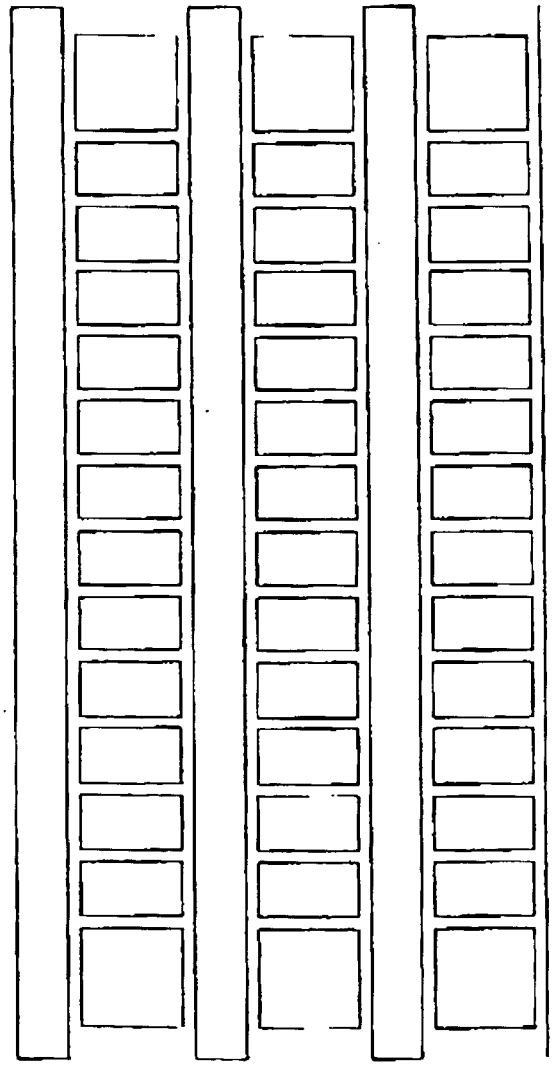
FIG. 17 is a front elevational view of a completed 3-step stoop having been made with three row lock course risers.

There is shown in FIGS. 17 and 18, a typical application of the use of the finished novel row lock course type precast riser. Illustrated in a 3-step stoop using three of the novel prefabricated concrete risers. Completing the stoop are the stone treads and the side walls using matching conventional bricks to fill in the sidewall.

It should be understood that although the present invention is described in detail for its particular embodiments, there may be other variations and modifications that will become apparent to those who are skilled in the art upon his speciication, and that these modifications or variations that can be made should not detract from the true spirit of this invention.

What is claimed is:

1. A method for forming a precast brick-faced riser module, comprising the steps of:

a. providing a plurality of brick slabs;

b. providing a rectangular shaped form having two side walls, rectangular in shape, with two end walls and a bottom portion, and two end cap gages, each side wall having a pair of grooved notches to receive the end cap engages, the notches having a width and height sized to a thickness of a brick slab, and a scraper sized to a thickness of a brick slab;

c. pouring concrete into the form to a midpoint until the form is half filled with concrete;

d. placing a reinforcing rod in the form for added strength of the module;

e. filling the form with additional concrete to a full height of the form;

f. inserting the end gages into a respective pair of grooved notches;

g. removing an excess of concrete from a top surface of the concrete that lies between the grooved notches using the scraper to gage and control an amount of concrete removed from the top surface of the concrete equal to the thickness of the brick slab to maintain each brick slab flush with the height of the form;

h. pressing each of the brick slabs, flush with a height of the form and arranged in a row lock course pattern, into the concrete to imbed them permanently in place;

i. filling the joints between the brick slabs with additional concrete;

j. removing the form after the concrete is set for twenty-four hours; and, k. transporting the riser from a manufacturing location to a stoop under repair as an integral piece for placement under and permanent support of a tread.

2. The method of claim 1, further comprising:

l. adding brick slabs to each end of the riser using a thin set mortar to give an appearance of end caps made of sandstone.

3. The method in accordance with claim 2, wherein the reinforcing rod is positioned parallel to a radial axis of said rectangular form, said precast brick-faced riser being formed as a modular unit that is transportable to a stoop under repair as an integral piece for placement under a stone tread for permanent support of the tread.

4. The method of claim 3, wherein each brick slab for the row lock course is a slice of a standard brick formed by cutting each end from a standard rectangular brick with a cut parallel and proximate each end of the brick to provide an irregular underside and a smooth outer surface for each brick slab.

5. The method of claim 4, wherein the prefabricated riser is positioned under the tread in the stoop on a plurality of shims in place of an old brick course and wherein all open joints are pointed with mortar trimmed flush with a brick veneer.

6. The method of claim 5, wherein each sidewall of the stoop is completed with matching conventional bricks to fill in each sidewall.

* * * * *